United States Patent [19]

McCall et al.

[11] Patent Number: 4,761,321

[45] Date of Patent: Aug. 2, 1988

[54] CORRUGATED WOVEN FABRIC

[75] Inventors: Clyde A. McCall, Walhalla, S.C.; Michael J. Campbell, Roswell; William B. Dean, Cornelia, both of Ga.

[73] Assignee: Chicopee, New Brunswick, N.J.

[21] Appl. No.: 33,921

[22] Filed: Apr. 1, 1987

Related U.S. Application Data

[63] Continuation of Ser. No. 790,993, Oct. 24, 1985, abandoned, which is a continuation-in-part of Ser. No. 623,657, Jun. 22, 1984, abandoned.

[51] Int. Cl.[4] ..... B32B 1/00

[52] U.S. Cl. ..... 428/176; 28/156; 428/179; 428/225; 428/229; 428/257; 428/258; 428/259

[58] Field of Search ..... 28/156; 428/176, 179, 428/225, 229, 257, 258, 259

[56] References Cited

U.S. PATENT DOCUMENTS 4,128,684 12/1978 Bomis et al. ..... 428/259

4,321,735 3/1982 Black ..... 28/156

*Primary Examiner*—James J. Bell

[57] ABSTRACT

A heat shrunk, high bulk, elastic, corrugated fabric comprising low shrink fill yarns and an alternating pattern of high shrink and ultra low shrink texturized warp yarns; and wherein substantially parallel corrugations extending along the fill direction are formed by repeated sinuous twists of the low shrink warp yarns.

16 Claims, 2 Drawing Sheets

CORRUGATED WOVEN FABRIC

This is a continuation of application Ser. No. 790,993, filed Oct. 24, 1985, now abandoned, which is a continuation-in-part of patent application Ser. No. 623,657, filed June 22, 1984, abandoned.

BACKGROUND OF THE INVENTION

There are many known methods for bulking or creping fabrics. One such method is set forth in U.S. Pat. Nos. 2,081,370 to Secrist and 3,837,344 to Patience. The method disclosed therein, though it provides bulk, does not provide a means for forming a fabric with a controlled pattern of corrugations. In addition, the patterns therein will be lost upon wetting.

U.S. Pat. No. 3,655,327 to Rollins discloses a method of creating a stretched characteristic in a woven fabric by creping in a manner known as "crimp interchange". In a preferred method set forth in that patent, some of the yarns comprise thermoplastic materials which are heat set after the crimp interchange to fix the creping and permanently establish the stretch characteristics of the fabric. This patent does not, however, set forth a method for making a fabric having a controlled pattern of corrugations as disclosed by the present invention.

In the typical methods for creping fabrics, the crepe pattern is established by after treatment of a finished woven fabric and not by the initial selection of yarns. In the present invention the corrugated final structure is created by and determined by the choice of patterns and of the yarns used to form the fabric.

Elastic rubber strands have also been incorporated into fabrics to pucker or bulk the fabrics. However, they are expensive and detract from the textile appearance and performance of the formed fabric. Texturized thermoplastic yarns have also been included in fabrics having a heat shrunk puckered bulk appearance. Alternating warp yarns yarns with varying degrees of shrink has also been used to produce fabrics with puffs, to develop depth in a fabric, and to create spacer fabrics wherein the low shrink yarns occupy the center portion of the final fabric, creating a space between the more highly shrink yarns, which move to the surfaces of the fabric. However, before the invention herein described no one has used a pattern of high shrink and low shrink texturized yarns to provide controlled corrugations or undulations in the entire fabric.

SUMMARY OF THE INVENTION

The present invention comprises a high bulk, elastic, corrugated fabric and method of making the same. The fabric is formed by heat shrinking of a precursor fabric comprising an open pattern of low shirnk or ultra low shrink fill yarns and alternating high shrink and ultra-low shrink texturized thermoplastic warp yarns. In the heat shrunk corrugated fabric, substantially parallel corrugations or undulations are formed extending in the fill direction. The corrugations are formed by repeated sinuous twists in the ultralow shrink warp yarns. In one preferred embodiment, the repeated sinuous twist in the alternating warp yarns form complimentary sinuous twists in the adjacent warp yarns. In another preferred construction, the sinuous twists in the alternative ultra-low shrink yarns overlap the adjacent high shrink warp yarns creating extremely high loft in the fabric. In still another preferred construction, the warp yarns comprise a repeating pattern of one high shrink yarn and two ultra low shrink yarns. The heat shrunk, high shrink, warp yarns have a high elasticity and together with the corrugations provide a bulky highly elastic material or fabric. The high shrink and ultralow shrink yarns may be made from nylon, polyester, polypropylene, or acrylic and are preferably continuous filament yarns. The low shrink fill yarns may comprise heat set continuous filament thermoplastic yarns, or cotton, rayon, or mixtures thereof.

The method of the present invention comprises weaving or knitting a precursor fabric of low shrink or ultra/low shrink fill yarns and alternating high shrink and ultra low shrink warp yarns, and subjecting that precursor fabric to heat treatment to form the final corrugated fabric. The fabric of the present invention has many uses but is particularly applicable as a fluff sponge or high bulk bandage, due to its extremely high loft and bulk and its wet stability.

DETAILED DESCRIPTION OF THE INVENTION

The present invention comprises a corrugated fabric and a method for making the same. The fabric is made from a precursor woven or knitted fabric which is heat shrunk to produce the corrugations or undulations in the final fabric. The woven or knitted fabric utilizes a pattern of high shrink and ultralow shrink texturized thermoplastic yarns in the warp direction. A preferred pattern of warp yarns for a woven precursor fabric and method of the present invention is set out in FIG. 1 and is shown generally at 10. The repeating pattern of high shrink yarns 14 and ultralow shrink yarns 16 is set forth in the ABBABB sequence at the top of FIG. 1. A similar ABBABB sequence may be used to set in the wales on a warp knitting machine, to produce a knitted fabric according to the present invention. In the knitted fabric of the present invention the fill yarns forming the courses of the fabric may be low shrink yarns or ultra low shrink yarns. As used in the present application, the term "high shrink" refers to a yarn having at least 35% shrinkage in boiling water, and the term "ultralow shrink" refers to a yarn having no more than 5% shrinkage in boiling water.

Figure 1:
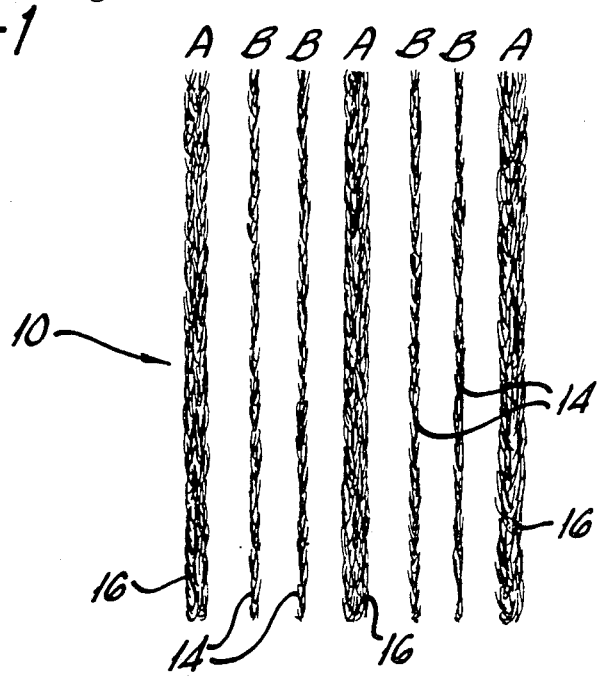
FIG. 1 shows a schematic representation of the warp yarn of a precursor fabric for forming a preferred embodiment of the fabric of the present invention.
Figure 2:
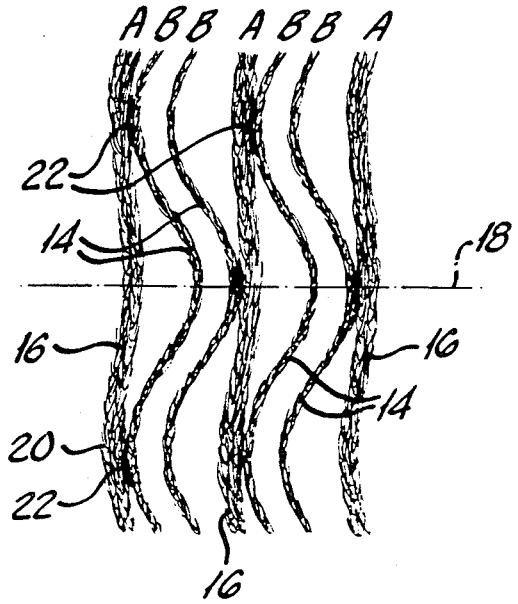
FIG. 2 shows a schematic representation of the warp yarns of FIG. 1 as they appear in the final corrugated fabric, after heat treatment.

FIG. 2 gives a schematic representation of the yarns of FIG. 1 following heat treatment and as they appear in the final fabric. The ultralow shrink yarns 16 are twisted in a repeated sinuous pattern forming corrugations or undulations in the final fabric along the line shown at 18. In a preferred embodiment of the fabric of the present invention, the repeated sinuous twists of the alternating warp yarns, 14, form complimentary low level sinuous twists, 20, in the adjacent warp yarns, 12. In another preferred embodiment, the sinuous twists of the ultralow shrink yarns overlap the adjacent high shrink yarns as shown at 22. It is not essential to the present invention that the warp yarns be disposed in the pattern ABBABB as shown in FIG. 1, but only that there exist alternating high shrink and ultralow shrink yarns to produce the corrugations.

The fill yarns used in the fabrics in the method of the present invention may be low shrink yarns having at least about 5% but less than about 20% shrinkage in boiling water or ultra low shrink yarns. The low shrink yarns may comprise heat set continuous filament texturized thermoplastic yarns, or cotton, or rayon yarns. In a preferred embodiment of the present invention, the precursor fabric comprises a 27 warp yarns per inch and 18 fill yarns per inch. However, weave patterns of from 15 to 30 warp yarns per inch and from 10 to 25 fill yarns per inch are contemplated by the present invention.

The texturized thermoplastic yarns of the present invention may comprise continuous filament or staple filament yarns. In a preferred embodiment, the thermoplastic yarns comprise nylon or polyester yarns. In a still preferred embodiment, the texturized thermoplastic yarns comprise 150 denier, 30 to 34 filament per strand continuous filament yarns. In a preferred embodiment of the present invention, pictured in FIG. 3, the corrugations extend along the fill direction and are shown in the vertical direction. The fabric depicted comprises an ABBABB pattern of warp yarns. The repeated sinuous twists of the double strands of ultralow shrink warp yarns are readily visible.

Figure 3:
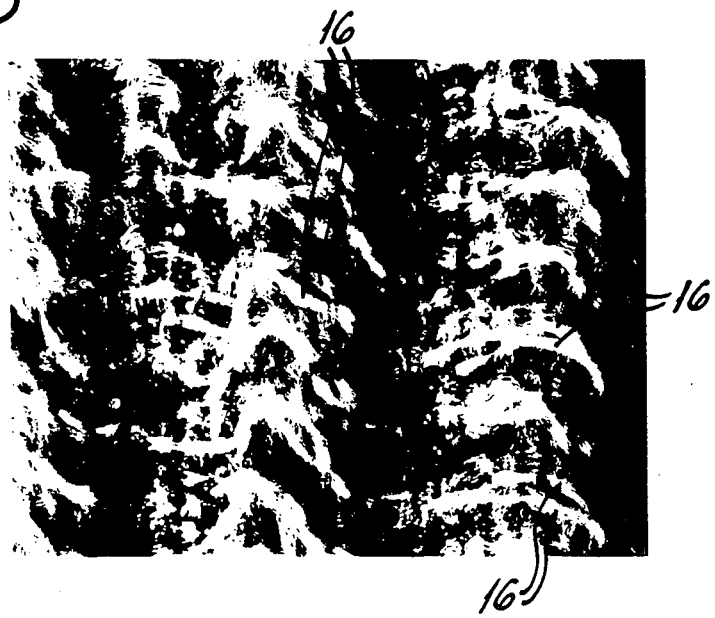
FIG. 3 is a photomicrograph of a preferred embodiment of the fabric of the present invention, lit from above.
Figure 4:
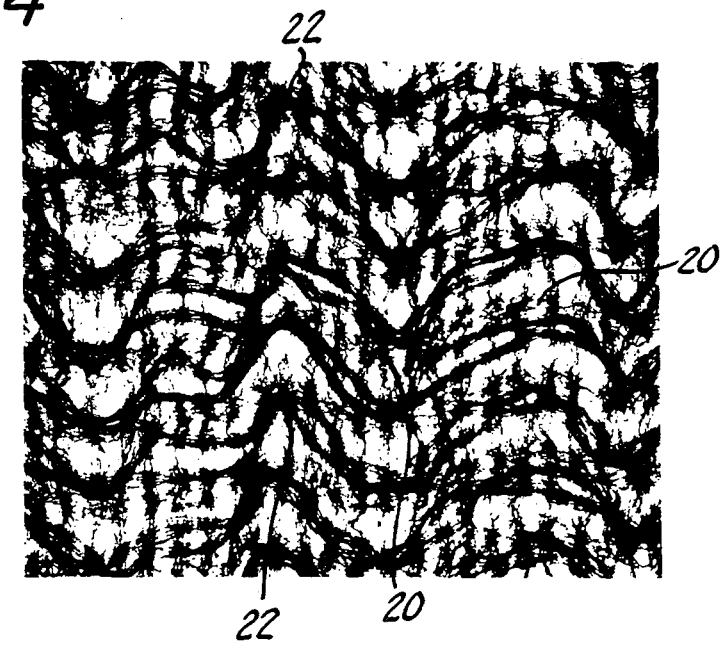
FIG. 4 is a photomicrograph of the fabric sample shown in FIG. 3, lit from below.

As may be seen in FIG. 4, showing the same fabric sample as FIG. 3, lit from below, in this preferred construction, the sinuous twists of the ultralow shrink yarns form complimentary low level sinuous twists 20 in the adjacent warp yarns, and in fact overlie adjacent high shrink warp yarns at 22. In the particular embodiment shown, both the warp sand fill yarns comprise a 150 denier, 30 to 34 filament per strand of continuous filament texturized polyester yarns.

According to the method of the present invention, a precursor fabric is woven or knitted of low shrink or ultra low shrink fill yarns and an alternating pattern of high shrink and ultra low shrink warp yarns. Suitable high shrink yarns are sold commercially and are often termed "power stretch" yarns. The use of these yarns yields a fabric which is highly elastic in the warp direction. Ultralow shrink yarns are also commercially available. Suitable low shrink yarns for use in the present invention are the commercially available "heat set" yarns. In the method of the present invention, heat is applied to the precursor fabric to shrink the yarns and form the corrugated final fabric. The degree of heat treatment required, in terms of both temperature and time of application, may be readily determined fo each type of yarn and according to the desired level of shrinkage and elasticity desired in the final fabric. In a preferred method of the present invention, heated air at 250° F. is applied to the unrestrained precursor fabric for a period of at least 15 seconds. If desired, the precursor fabric may be subjected to a preshrinking step to facilitate further processing. For many final fabric applications it may also be desired to scour and rinse the precursor fabric, and to apply antistat and/or surfactant compositions, prior to heat treatment.

The foregoing description and drawings are illustrative but are not to be taken as limiting. Other variations and modifications are possible without departing from the spirit and scope of the present invention.

We claim:

1. A high bulk, heat shrunk, corrugated fabric formed by heat treatment of a woven precursor fabric comprising low shrink fill yarns and alternating ultra low shrink and highly elastic high shrink texturized thermoplastic warp yarns, said corrugated fabric comprising substantially parallel corrugations extending along the fill direction, said corrugations formed by repeated sinuous twists of the ultra low shrink warp yarns.

2. A high bulk, heat shrunk, corrugated fabric formed by heat treatment of a woven precursor fabric comprising ultra low shrink fill yarns and alternating ultra low shrink and highly elastic high shrink texturized thermoplastic warp yarns, said corrugated fabric comprising substantially parallel corrugations extending along the fill direction said corrugations formed by repeated sinous twists of the ultra low shrink warp yarns.

3. The fabric of claim 1 or 2 wherein the repeated sinuous twists of said ultra low shrink warp yarns form a complimentary sinuous twist in the adjacent texturized warp yarns.

4. The fabric of claim 1 or 2 wherein repeated sinuous twists of the ultra low shrink warp yarns overlie adjacent high shrink texturized warp yarns.

5. The fabric of claims 1 or 2 wherein the alternating warp yarns comprise a repeating pattern of one high shrink texturized yarn and two ultralow shrink yarns.

6. The fabric of claim 5 wherein said high shrink texturized warp yarns comprise nylon, polyester, polypropylene, or acrylic yarns.

7. The fabric of claims 1 or 2 wherein said fill yarns comprise heat set continuous filament thermoplastic yarns.

8. The fabric of claims 1 or 2 wherein said fill yarns comprise cotton or rayon yarns.

9. The fabric of claims 1 or 2 wherein said fill yarns are polyester.

10. A method of making a high bulk, elastic, corrugated fabric comprising the steps of:

(a) forming a precursor fabric comprising low shrink yarns extending in a first direction interlaced with alternating ultra low shrink and high shrink texturized thermoplastic yarns extending in a second direction substantially at right angles to said first direction.

(b) heat treating said precursor fabric to shrink said texturized yarns and form said corrugated fabric having substantially parallel corrugations extending along said first direction, wherein said heat shrunk texturized yarns are highly elastic.

11. A method of making a high bulk, elastic, corrugated fabric comprising the steps of:

(a) forming a precursor fabric comprising ultra low shrink yarns extending in a first direction interlaced with alternating ultra low shrink and high shrink texturized thermoplastic yarns extending in a second direction substantially at right angles to said first direction.

(b) heat treating said precursor fabric to shrink said texturized yarns and form said corrugated fabric having substantially parallel corrugations extending along said first direction, wherein said heat shrunk texturized yarns are highly elastic.

12. The method of claim 10 or 11 wherein the precursor fabric is a woven fabric, and the yarns extending in the first direction are the fill yarns, and the yarns extending in the second direction are the warp yarns.

13. The method of claim 12 wherein the alternating ultralow shrink and high shrink warp yarns of the precursor fabric formed in step (a) comprise a repeating pattern of one high shrink texturized yarn and two ultra low shrink yarns.

14. The method of claims 10 or 11 wherein said texturized warp yarns extending in said second direction comprise nylon, polyester, polypropylene or acrylic yarns.

15. The method of claim 10 wherein the low shrink fill yarns extending in said first direction are heat set polyester yarns.

16. The method of claim 10 wherein the low shrink yarns extending in said first direction are cotton or rayon.

* * * * *